US005640157A

United States Patent [19]

Langeraar

[11] Patent Number: 5,640,157

[45] Date of Patent: Jun. 17, 1997

[54] INFORMATION SYSTEM FOR A SHIP

[75] Inventor: Huibert Barend Langeraar, Hengelo, Netherlands

[73] Assignee: Hollandse Signaalapparaten B.V., Hengelo, Netherlands

[21] Appl. No.: 564,471

[22] Filed: Nov. 29, 1995

[30] Foreign Application Priority Data

Dec. 15, 1994 [NL] Netherlands ..... 9402126

[51] Int. Cl.[6] ..... G08B 23/00

[52] U.S. Cl. ..... 340/984; 340/573; 340/825.49; 455/53.1

[58] Field of Search ..... 34/984; 348/573; 340/825.49, 825.73; 455/53.1

[56] References Cited

U.S. PATENT DOCUMENTS

| | | | |
|---|---|---|---|
| 3,439,320 | 4/1969 | Ward | 340/825.49 |
| 3,739,329 | 6/1973 | Lester | 340/825.49 |
| 3,805,265 | 4/1974 | Lester | 340/825.49 |
| 4,225,953 | 9/1980 | Simon et al. | 340/825.49 |
| 4,275,385 | 6/1981 | White | 340/825.49 |
| 4,837,568 | 6/1989 | Snaper | 340/825.49 |
| 4,990,892 | 2/1991 | Guest et al. | 340/573 |
| 5,062,151 | 10/1991 | Shipley | 340/825.49 |
| 5,317,309 | 5/1994 | Vercellotti et al. | 340/825.49 |
| 5,319,363 | 6/1994 | Welch et al. | 340/825.49 |
| 5,396,224 | 3/1995 | Dukes et al. | 340/573 |

FOREIGN PATENT DOCUMENTS

| | | |
|---|---|---|
| 0295085 | 12/1988 | European Pat. Off. . |
| 2630565 | 10/1989 | France . |
| 2193359 | 2/1988 | United Kingdom . |

*Primary Examiner*—Jeffery Hofsass
*Assistant Examiner*—John Tweel, Jr.
*Attorney, Agent, or Firm*—Oblon, Spivak, McClelland, Maier & Neustadt, P.C.

[57] ABSTRACT

The invention relates to an information system for a ship (1), and in particular for providing information about the position of ship's crew members when a calamity occurs. For that purpose the ship's crew members are provided with an identification means having a built-in transponder and the ship is provided with a number of detectors (3*i*) and with a central unit (5).

8 Claims, 3 Drawing Sheets

INFORMATION SYSTEM FOR A SHIP

BACKGROUND OF THE INVENTION

The invention relates to an information system for a ship, for providing information concerning the ship in case of crisis situations, comprising a system of detectors disposed in at least substantially each ship's compartment, a communication system and a central unit for processing the information generated by the detectors and supplied by the communication system regarding the conditions prevailing in the compartments comprising the detectors.

Such a system will generally be present on a ship, for instance designed as a system of fire detectors connected to a central fire-alarm unit.

SUMMARY OF THE INVENTION

According to the inventive principle underlying the invention, such a system can be used for further protective purposes. The invention is thereto characterized in that a detector is also designed for detecting the presence of crew members in the compartment comprising the detector.

In this context it is not the object to continuously monitor each crew member, but rather to be able, after a calamity, for example the impact of a missile, to determine who were present in the stricken area. A favourable embodiment of the invention is thereto characterized in that detection means for detecting a crisis situation and memory means for storing the positions of crew members at least substantially at the time of the crisis situation have been provided. This could for instance be a memory which, in a cyclical manner, is continually updated with new information, the older information being continually overwritten. The writing of information stops shortly after the occurrence of a crisis situation.

A further favourable embodiment of the invention is characterized in that the central unit is designed for displaying the positions stored in the memory means, which enables a reconstruction of crew member activities at the time of the crisis situation.

A special embodiment enables the detector, which is basically designed for the detection of for instance smoke, fire, water etc., to also generate an electromagnetic radiation field in the compartment in which the detector is disposed, which radiation field is capable of activating a repeater well-known in the art to be worn by a crew member. The repeater may for instance form part of an identification badge to be worn by each crew member. An at least periodical generation of this radiation field reduces the radiation load for the crew members. The detector is then further arranged for the detection of an activated repeater and the central unit is capable of establishing the identity of the crew member or crew members in the compartment concerned via the communication system. The repeater shall preferably be of the passive type to prevent logistic problems with batteries and to enhance overall reliability.

An advantageous embodiment of the invention, in which the radiation load can still be further reduced, is characterized in that the radiation field is generated at least substantially near the entrance to the compartment. In spite of the fact that the radiation does not cover the entire room, it is nevertheless possible to accurately determine the whereabouts of a crew member in a crisis situation.

BRIEF DESCRIPTION OF THE DRAWINGS

The invention will now be further described with reference to the following figures, of which.

DETAILED DESCRIPTION OF THE INVENTION

Figure 1:
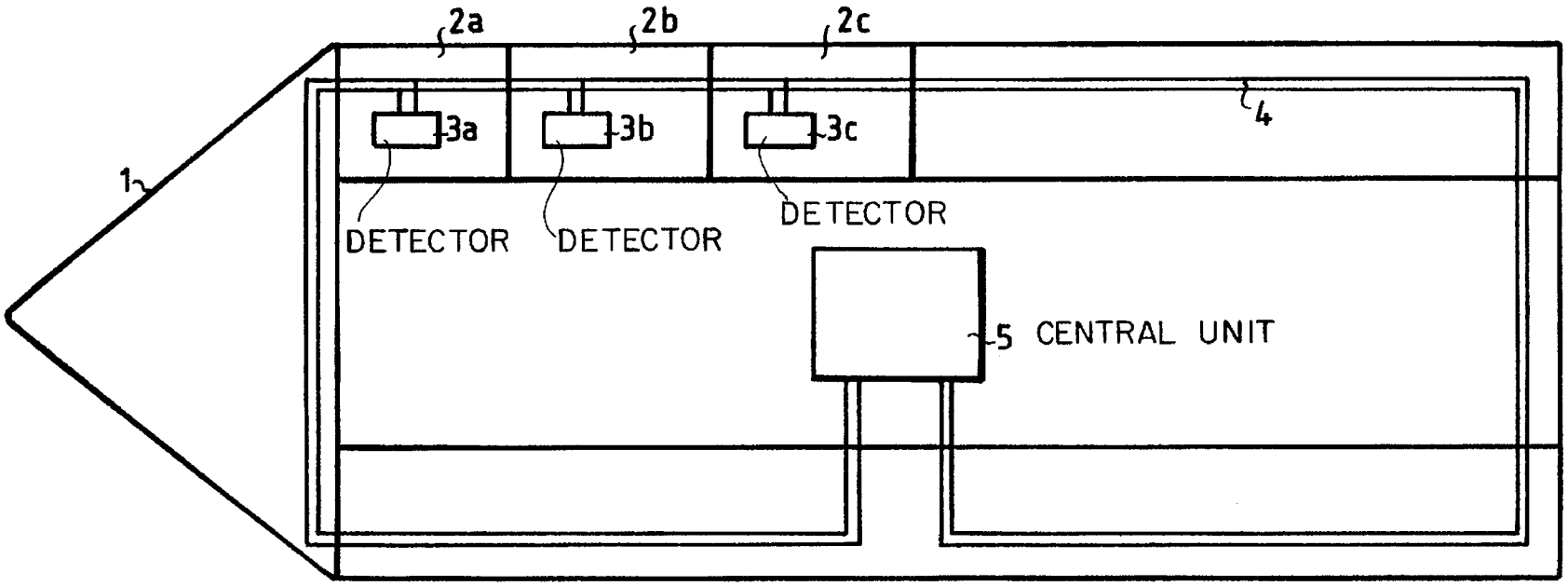
FIG. 1 represents a diagram of a possible embodiment of the information system.

FIG. 1 schematically represents a possible embodiment of the information system according to the invention. A ship 1, in this figure schematically represented with only one deck, is provided with a number of compartments 2*a*, 2*b*, 2*c* etc. Each compartment is provided with a detector 3*a*, 3*b*, 3*c* etc, which detectors are connected to a communication system 4, in this figure represented as a two-wire induction loop. Additionally, a central unit 5 is connected to the communication system 4. Each detector is provided with an individual address and central unit 5 polls each detector 3*i* by transmitting, via communication system 4, the address of the detector 3*i* to be interrogated. The detector 3*i* thus addressed subsequently returns all available information via communication system 4. Communication system 4 may for instance be designed as a partyline, well-known in the art, with which a large number of connected units can communicate.

The present invention predominantly relates to information concerning crew members who might be present in a compartment 2*i*. To this end, detector 3*i* is equipped with a transmitter for generating an electromagnetic radiation field in compartment 2*i*. Each crew member is equipped with a repeater, well-known in the art, which is activated by the radiation field and which in turn affects the electro-magnetic radiation field or generates a second radiation field such that the identity of the bearer is revealed in the form of a code. Detector 3*i* is, in a manner known in the prior art, arranged for detecting this code and in turn transmits the code via the communication system 4. This causes the central unit 5 to be continually aware of the whereabouts of the entire crew. No particular demands are placed on the repeater. However, it shall preferably be a type of repeater that is capable of performing in a low-intensity radiation field, so as to ensure a low radiation load for the crew members. Furthermore, it shall preferably be a passive type of repeater to prevent logistic problems with batteries and to improve overall reliability. An advantageous option which meets both criteria, is a repeater based on a harmonic generator, well-known in the art.

Figure 2:
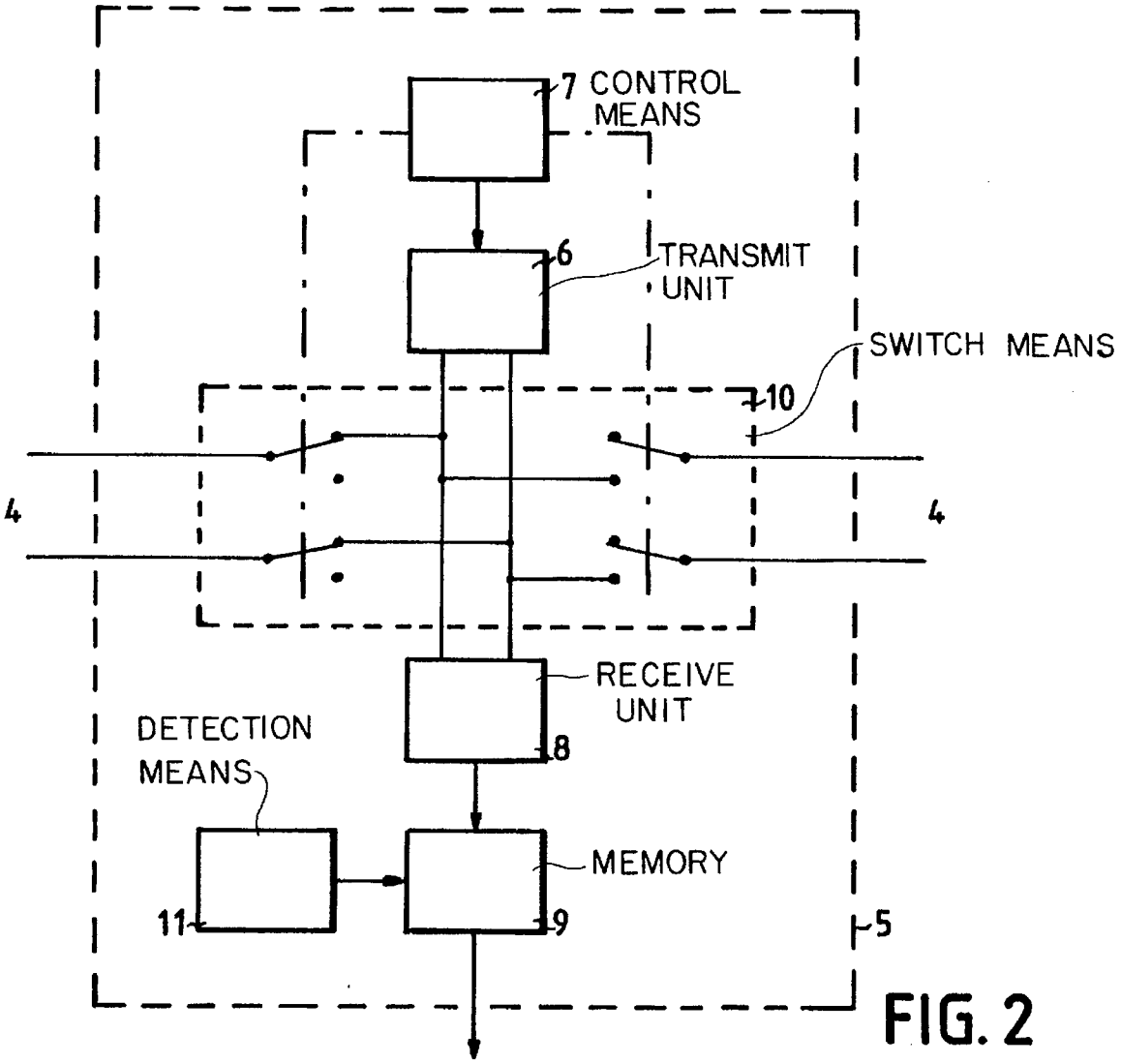
FIG. 2 schematically represents a possible embodiment of the central unit.

FIG. 2 schematically represents a feasible embodiment of the central unit 5. A transmit unit 6, controlled by control means 7, recurrently transmits an address resulting in the activation of precisely one detector 3*i*. Detector 3*i* subsequently determines who is present in the compartment 2*i* and returns this information, possibly in combination with other information concerning compartment 2*i*, to central unit 5, where it is received, if necessary filtered or otherwise preprocessed in a receive unit 8 after which it is stored in a memory 9. Switch means 10 can be controlled by control means 7 and allow the clockwise or counterclockwise transmission of messages via communication system 4. This entails the advantage that even a local damage of communication system 4 will not prevent the majority of the detectors 3*i* to be addressed.

The information system described herein is predominantly concerned with determining the whereabouts of crew members in a crisis situation. In view of this, the information system is provided with detection means 11 for detecting a crisis situation, for instance acceleration transducers, alarm buttons or means for assessing damage caused to the ship's hull. In that case, the information known to central unit 5 is released. This can be advantageously effected by the storage of the information in a memory that is cyclically updated with new information, the older information being continually overwritten. By stopping this process shortly after the occurrence of a crisis situation, a detailed image of the conditions prevailing at the time of the crisis situation can be obtained. This information can for instance be visualized on a display unit connected to central unit 5.

Figure 3:
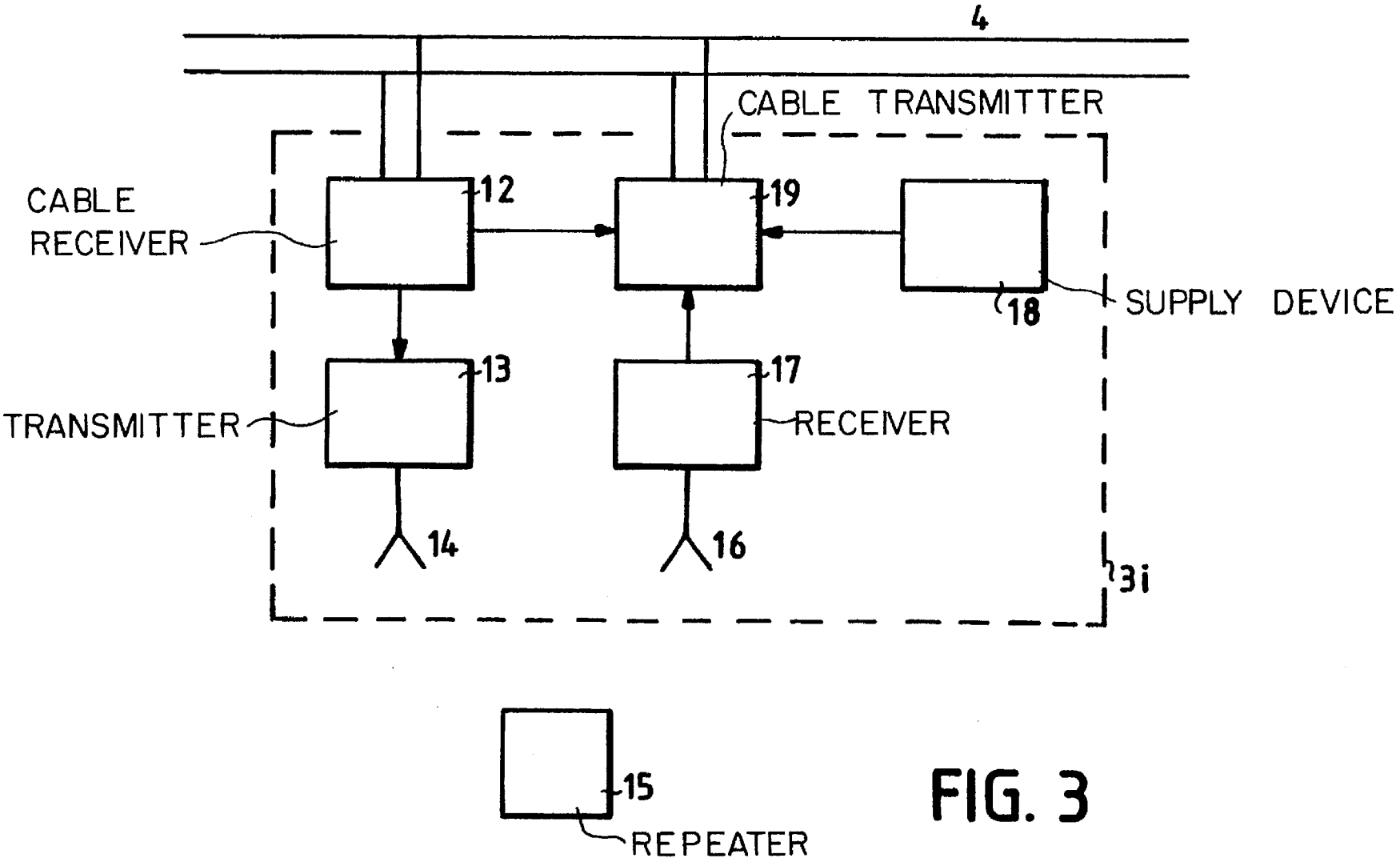
FIG. 3 schematically represents a possible embodiment of a detector.

FIG. 3 schematically represents a feasible embodiment of a detector 3*i*. Via communication system 4, cable receiver 12 receives an address transmitted by central unit 5. If this address corresponds to an address permanently stored in cable receiver 12, the latter activates a transmitter 13 which generates an electro-magnetic radiation field via transmit antenna 14. A repeater 15 located in the radiation field affects this radiation field or independently generates a second radiation field, which is detected via receive antenna 16 and receiver 17. In combination with other information concerning the compartment 2*i* comprising detector 3*i*, obtained via additional information supply device 18, the codes thus derived from one or several repeaters 15 are applied to a cable transmitter 19 which transmits this information via communication system 4 to central unit 5 at a predetermined point of time after reception of the correct address.

It is of advantage to position detector 3*i* in compartment 2*i* near the entrance(s) to compartment 2*i*. This enables low-energy transmissions and reduces the risks of many repeaters being simultaneously present in the radiation field.

I claim:

1. An information system for a ship, for providing information concerning the ship in case of crisis situations, comprising:

a system of detectors disposed in at least substantially each ship's compartment and capable of detecting the presence of crew members;

a crisis detection means for detecting a crisis situation;

a central unit for processing information detected by said system of detectors and said crisis detection means;

a communication system for supplying information detected by said system of detectors and said crisis detection means to said central unit;

a memory means for storing positions of crew members at least substantially at the time of the crisis situation; and a display means connected to the memory means for displaying the positions of crew members after detection of a crisis situation by said crisis detection means.

2. An information system as claimed in claim 1, further comprising:

a plurality of repeaters, one repeater worn by each crew member;

each detector of said system of detectors periodically generating an electromagnetic radiation field capable of activating any of said plurality of repeaters.

3. An information system as claimed in claim 2, further comprising:.

each detector of said system of detectors capable of detecting an activated repeater.

4. An information system as claimed in claim 2, further comprising:

each of said plurality of repeaters transmits upon activation.

5. An information system as claimed in claim 2, further comprising:

each of said plurality of repeaters operating on the basis of a harmonic generator.

6. An information system as claimed in claim 2, further comprising:.

each of said plurality of repeaters forming part of a visual identification means.

7. An information system as claimed in claim 2, further comprising:

said central unit capable of establishing a crew member's identity.

8. An information system as claimed in claim 7, further comprising:

said electromagnetic radiation field being generated at least substantially near the entrance to the compartment.

* * * * *